US009881623B2

(12) United States Patent
Nakamura et al.

(10) Patent No.: US 9,881,623 B2
(45) Date of Patent: Jan. 30, 2018

(54) DIGITAL WATERMARK EMBEDDING DEVICE, DIGITAL WATERMARK EMBEDDING METHOD, AND COMPUTER-READABLE RECORDING MEDIUM

(71) Applicant: KABUSHIKI KAISHA TOSHIBA, Tokyo (JP)

(72) Inventors: Masanobu Nakamura, Tokyo (JP); Masahiro Morita, Kanagawa (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 19 days.

(21) Appl. No.: 14/966,027

(22) Filed: Dec. 11, 2015

(65) Prior Publication Data

US 2016/0099003 A1 Apr. 7, 2016

Related U.S. Application Data

(63) Continuation of application No. PCT/JP2013/066110, filed on Jun. 11, 2013.

(51) Int. Cl.
*G10L 13/08* (2013.01)
*G10L 19/08* (2013.01)
(Continued)

(52) U.S. Cl.
CPC ..... *G10L 19/018* (2013.01); *G10L 13/06* (2013.01); *G10L 13/10* (2013.01); *G10L 13/08* (2013.01)

(58) Field of Classification Search
CPC ..... G10L 13/08; G10L 19/08
(Continued)

(56) References Cited

U.S. PATENT DOCUMENTS 7,526,430 B2 4/2009 Kato et al.
2002/0006212 A1* 1/2002 Rhoads ..... G06K 9/00442 382/100
(Continued)

FOREIGN PATENT DOCUMENTS

JP 11-190996 A 7/1999
JP 2002-297199 A 10/2002
(Continued)

OTHER PUBLICATIONS

Hofbauer, Konrad, Gernot Kubin, and W. Bastiaan Kleijn. "Speech watermarking for analog flat-fading bandpass channels." IEEE Transactions on Audio, Speech, and Language Processing 17.8 (2009): 1624-1637.*
(Continued)

*Primary Examiner* — Seong Ah A Shin
(74) *Attorney, Agent, or Firm* — Foley & Lardner LLP

(57) ABSTRACT

A digital watermark embedding device includes a synthesized voice generating unit that outputs a synthesized voice according to an input text and outputs phoneme-based alignment regarding phonemes included in the synthesized voice; an estimating unit that estimates whether or not a potentially risky expression is included in the input text, and outputs a potentially risky segment in which the potentially risky expression is estimated to be included; an embedding control unit that associates the potentially risky segment with the phoneme-based alignment, and decides and outputs an embedding time for embedding a watermark in the synthesized voice; and an embedding unit that embeds a digital watermark in the synthesized voice at a time specified as the embedding time for the synthesized voice.

7 Claims, 5 Drawing Sheets

(51) Int. Cl.
*G10L 19/018* (2013.01)
*G10L 13/06* (2013.01)
*G10L 13/10* (2013.01)

(58) Field of Classification Search
USPC ..... 704/260, 267
See application file for complete search history.

(56) References Cited

U.S. PATENT DOCUMENTS

2002/0055843 A1* 5/2002 Sakai ..... G10L 13/00 704/258
2002/0095577 A1* 7/2002 Nakamura ..... G06T 1/0071 713/176
2003/0028381 A1* 2/2003 Tucker ..... H04H 20/31 704/273
2006/0009977 A1* 1/2006 Kato ..... G10L 13/10 704/260
2011/0166861 A1* 7/2011 Wang ..... G10L 19/018 704/260
2016/0254003 A1* 9/2016 Tachibana ..... G10L 19/018 704/207

FOREIGN PATENT DOCUMENTS

JP 3575242 B2 10/2004
JP 3812848 B2 8/2006
JP 2007-156169 A 6/2007
JP 2007156169 A * 6/2007
JP 20070156169 A * 6/2007
JP 2007-333851 A 12/2007
JP 2009-86597 A 4/2009

OTHER PUBLICATIONS

Hofbauer et al.,"Speech watermarking for analog flat-fading bandpass channels." IEEE Transactions on Audio, Speech, and Language Processing 17.8 (2009): 1624-1637.*

* cited by examiner

DIGITAL WATERMARK EMBEDDING DEVICE, DIGITAL WATERMARK EMBEDDING METHOD, AND COMPUTER-READABLE RECORDING MEDIUM

CROSS-REFERENCE TO RELATED APPLICATION

This application is a continuation of PCT international application Ser. No. PCT/JP2013/066110 filed on Jun. 11, 2013 which designates the United States, incorporated herein by reference.

BACKGROUND OF THE INVENTION

1. Field of the Invention

Embodiments of the present invention are related to a digital watermark embedding device, a digital watermark embedding method, and a computer-readable recording medium.

2. Description of the Related Art

In the voice signal processing technology in recent years, it has become possible to synthesize various voices. However, it also involves risks such as impersonation with the voice of an acquaintance using the synthesized voice or misuse of the voice of a notable public figure. Moreover, because of being able to generate an imitated voice (a resembling voice) of somebody else, it is not possible to rule out a likely increase in impersonation frauds using the voice of acquaintances or a likely increase in criminal acts such as defamation by misusing the voice of notable public figures. In order to prevent such crimes from occurring, a technology has been developed in which a digital watermark is embedded in a synthesized voice so as to distinguish it from the real voice, and any misuse of the synthesized voice is detected.

Meanwhile, in the media contents in which resembling voices are created using the voice synthesis technology, in case the expressions that are banned in broadcasting, such as discriminatory terms or obscene expressions, are included or in case the expressions associated with crime are included; if such contents are mistakenly used, it may lead to a trust issue for the person whose voice has been resembled. In that regard, in a device capable of generating such synthesized voice, in order to deal with a case in which expressions that are banned in broadcasting are included, it becomes necessary to have a function for embedding an accurately-detectible digital watermark while maintaining the voice quality. However, there has been no proposal for implementing such a function in an effective manner.

Therefore, there is a need for a digital watermark embedding device capable of embedding a digital watermark having high detection accuracy while suppressing a degradation of the voice quality.

SUMMARY OF THE INVENTION

It is an object of the present invention to at least partially solve the problems in the conventional technology.

Embodiments according to the present invention provide a digital watermark embedding device that includes a synthesized voice generating unit that outputs a synthesized voice according to an input text and outputs phoneme-based alignment regarding phonemes included in the synthesized voice, an estimating unit that estimates whether or not a potentially risky expression is included in the input text, and outputs a potentially risky segment in which the potentially risky expression is estimated to be included, an embedding control unit that associates the potentially risky segment with the phoneme-based alignment, and decides and outputs an embedding time for embedding a watermark in the synthesized voice, and an embedding unit that embeds a digital watermark in the synthesized voice at a time specified as the embedding time for the synthesized voice.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

First Embodiment

Figure 1:
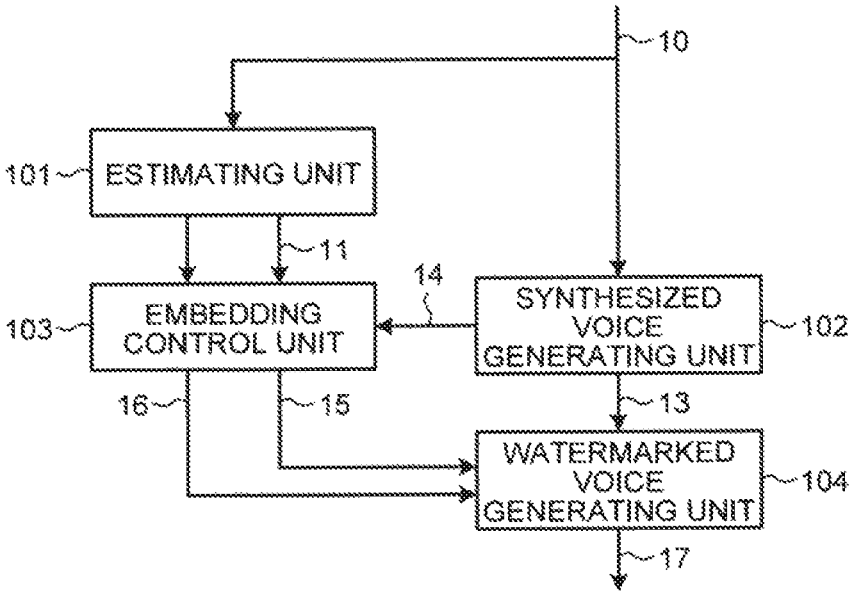
FIG. 1 is a block diagram illustrating a functional configuration of a digital watermark embedding device according to a first embodiment.

Exemplary embodiments of a digital watermark embedding device are described below with reference to the accompanying drawings. As illustrated in FIG. 1, a digital watermark embedding device 1 includes an estimating unit 101, a synthesized voice generating unit 102, an embedding control unit 103, and a watermarked voice generating unit 104. The digital watermark embedding device 1 receives input of an input text 10 containing character information, and outputs a synthesized voice 17 in which a digital watermark is embedded. The estimating unit 101 obtains the input text 10 from outside. In the following explanation, a "potentially risky segment" is defined as a voice section in which a "potentially risky expression" is used. Herein, a word, an expression, or a context that satisfies one of the following criteria is defined as a "potentially risky expression".

- words, expressions, and contexts, such as discriminatory terms or obscene expressions, that are not suitable in broadcasting
- words, expressions, and contexts associated with crimes such as impersonation frauds or associated with the planning of such crimes
- words, expressions, and contexts that may lead to defamation of other people The estimating unit 101 determines potentially risky segments from the input text 10, and determines the degree of risk of each such section. Herein, the input text 10 can represent intermediate language information, which is an expression in the text format of prosodic information obtained by performing text analysis. Regarding determination of the potentially risky segment, it is possible to think of the following methods, for example.

- a method in which a list of potentially risky expressions is stored and it is determined whether or not any expression in the list is included in the input text 10
- a method in which a list of potentially risky expressions is stored and it is determined whether or not any expression in the list is included in the input text 10 which has been subjected to morpheme analysis
- a method in which the probability of appearance of the word sequence (N-gram) including the potentially risky expressions is trained, and determination is performed using the likelihood of the input text 10 with respect to the word sequence
- a method in which an intention understanding module, which determines whether or not the input text 10 can be a potentially risky expression, is used in the estimating unit 101

In order to determine the degree of risk of a potentially risky segment, there can be various methods as given below

- a method in which each potentially risky expression in the list of potentially risky expressions is assigned with a degree of risk, and the degree of risk is calculated for such a potentially risky expression in the input text 10 which corresponds to that in the list
- a method in which each word sequence (N-gram) including a potentially risky expression is associated with a degree of risk, so that the degree of risk is assigned to the potentially risky expression appearing in the input text 10
- a method in which, in the intention understanding module, each context that can be a potentially risky expression is associated with a degree of risk so that, when the input text 10 can be a potentially risky expression, the degree of risk is assigned to the concerned context The estimating unit 101 outputs a potentially risky segment 11 and a degree of risk 12 of a potentially risky expression to the embedding control unit 103.

The synthesized voice generating unit 102 obtains the input text 10 from a user. Then, the synthesized voice generating unit 102 extracts prosodic information such as phoneme sequences, pauses, the mora count, and accents from the input text 10, and generates a synthesized voice 13. In order to adjust to the timing of embedding the digital watermark, it is necessary to have phoneme-based alignment regarding each uttered phoneme. For that reason, the synthesized voice generating unit 102 outputs phoneme-based alignment using the phoneme sequence, the pauses, and the mora count extracted from the input text 10. Then, the synthesized voice generating unit 102 outputs the synthesized voice 13 to the watermarked voice generating unit 104, and outputs the phoneme-based alignment 14 of the synthesized voice 13 to the embedding control unit 103.

The embedding control unit 103 receives input of the potentially risky segment 11 and the degree of risk 12 of the potentially risky expression as output by the estimating unit 101, as well as receives input of the phoneme-based alignment 14 output by the synthesized voice generating unit 102. Then, the embedding control unit 103 modifies the degree of risk 12 of the potentially risky expression as output by the estimating unit 101 into a watermark strength 15. The higher the degree of risk 12, the higher the watermark strength 15 is set. The watermark strength has the property that, when the watermark strength is increased, noise tolerance and codec tolerance is enhanced and the accuracy of watermark detection is enhanced but an unpleasant noise is perceived when heard by a person. In the first embodiment, it is an object to accurately detect the potentially risky expressions that are included in the synthesized voice 13 and that pose a high degree of risk if misused. Hence, even if there is some degradation in the voice quality, it is desirable to set the watermark strength at a high level. Meanwhile, instead of setting the watermark strength 15 based on the degree of risk 12, the watermark strength 15 of the sections including potentially risky expressions can be set at a high level without exception.

Based on the potentially risky segment 11 and the phoneme-based alignment 14, the embedding control unit 103 calculates an embedding timing 16 for embedding a watermark. The embedding timing 16 represents information about the timing for embedding the digital watermark at the strength specified as the watermark strength 15. Then, the embedding control unit 103 outputs the watermark strength 15 and the embedding timing 16 to the watermarked voice generating unit 104.

The watermarked voice generating unit 104 receives input of the synthesized voice 13 output by the synthesized voice generating unit 102, and receives input of the watermark strength 15 and the embedding timing 16 output by the embedding control unit 103. Then, at the timing specified as the embedding timing 16, the watermarked voice generating unit 104 embeds a digital watermark having the strength specified as the watermark strength 15, and generates the watermarked-synthesized voice 17.

Given below is the explanation of a method by which the watermarked voice generating unit 104 embeds a watermark. Herein, a method for embedding a digital watermark needs to satisfy the following two conditions.

Figure 2:
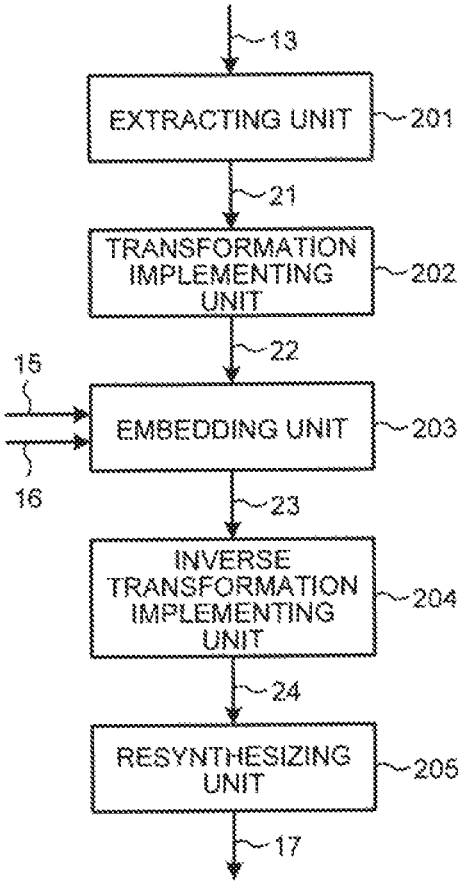
FIG. 2 is a block diagram illustrating a detailed configuration of a watermarked voice generating unit according to the first embodiment.

(1) at the time of generating the watermarked-synthesized voice 17, the watermark is embeddable in a potentially risky segment and the watermark is detectible (2) the strength at which the watermark is embedded is adjustable Explained with reference to FIG. 2 is a detailed functional configuration of the watermarked voice generating unit 104 that is capable of implementing a digital watermark embedding method which satisfies the abovementioned two conditions. As illustrated in FIG. 2, the watermarked voice generating unit 104 includes an extracting unit 201, a transformation implementing unit 202, an embedding unit 203, an inverse transformation implementing unit 204, and a resynthesizing unit 205.

The extracting unit 201 obtains the synthesized voice 13 from outside. Then, the extracting unit 201 clips, per unit of time, a voice waveform having a duration 2 T (for example, 2 T=64 milliseconds) from the synthesized voice 13, and generates a unit voice frame 21 at a time (t). In the following explanation, the duration 2 T is also called an analysis window length. In addition to performing the operation of clipping a voice waveform having the duration 2 T, the extracting unit 201 can also perform an operation of removing the direct-current component of the clipped voice waveform, an operation for accentuating the high-frequency component of the clipped voice waveform, and an operation of multiplying the window function (for example, the sine window) by the clipped voice waveform. Then, the extracting unit 201 outputs the unit voice frame 21 to the transformation implementing unit 202.

The transformation implementing unit 202 receives input of the unit voice frame 21 from the extracting unit 201. Then, the transformation implementing unit 202 performs orthogonal transformation with respect to the unit voice frame 21 and projects the unit voice frame 21 onto the frequency domain. The orthogonal transformation can be performed according to a transformation method such as the discrete Fourier transform, the discrete cosine transform, the modified discreet cosine transform, the sine transform, or the discrete wavelet transform. Then, the transformation implementing unit 202 outputs a post-orthogonal-transformation unit frame 22 to the embedding unit 203.

The embedding unit 203 receives input of the unit frame 22 from the transformation implementing unit 202, the watermark strength 15, and the embedding timing 16. Then, if the unit frame 22 represents a unit frame specified at the embedding timing 16, the embedding unit 203 embeds a digital watermark having a strength based on the watermark strength 15 in the specified subband. Meanwhile, the method for embedding a digital watermark is described later. Then, the embedding unit 203 outputs a watermarked unit frame 23 to the inverse transformation implementing unit 204.

The inverse transformation implementing unit 204 receives input of the watermarked unit frame 23 from the embedding unit 203. Then, the inverse transformation implementing unit 204 performs inverse orthogonal transformation with respect to the watermarked unit frame 23 and returns it to the time domain. The inverse orthogonal transformation can be performed according to the inverse discrete Fourier transform, the inverse discrete cosine transform, the inverse modified discreet cosine transform, the inverse discrete sine transform, or the inverse discrete wavelet transform. However, it is desirable that the inverse orthogonal transformation corresponds to the orthogonal transformation implemented by the transformation implementing unit 202. Then, the inverse transformation implementing unit 204 outputs a post-inverse-orthogonal-transformation unit frame 24 to the resynthesizing unit 205.

The resynthesizing unit 205 receives input of the post-inverse-orthogonal-transformation unit frame 24 from the inverse transformation implementing unit 204. Then, with respect to the post-inverse-orthogonal-transformation unit frame 24, the resynthesizing unit 205 overlaps the previous and next frames and obtains a sum of the frames so as to generate the watermarked-synthesized voice 17. Herein, it is desirable that the previous and next frames are overlapped over, for example, the duration T that is half of the analysis window length 2 T.

Figure 3:
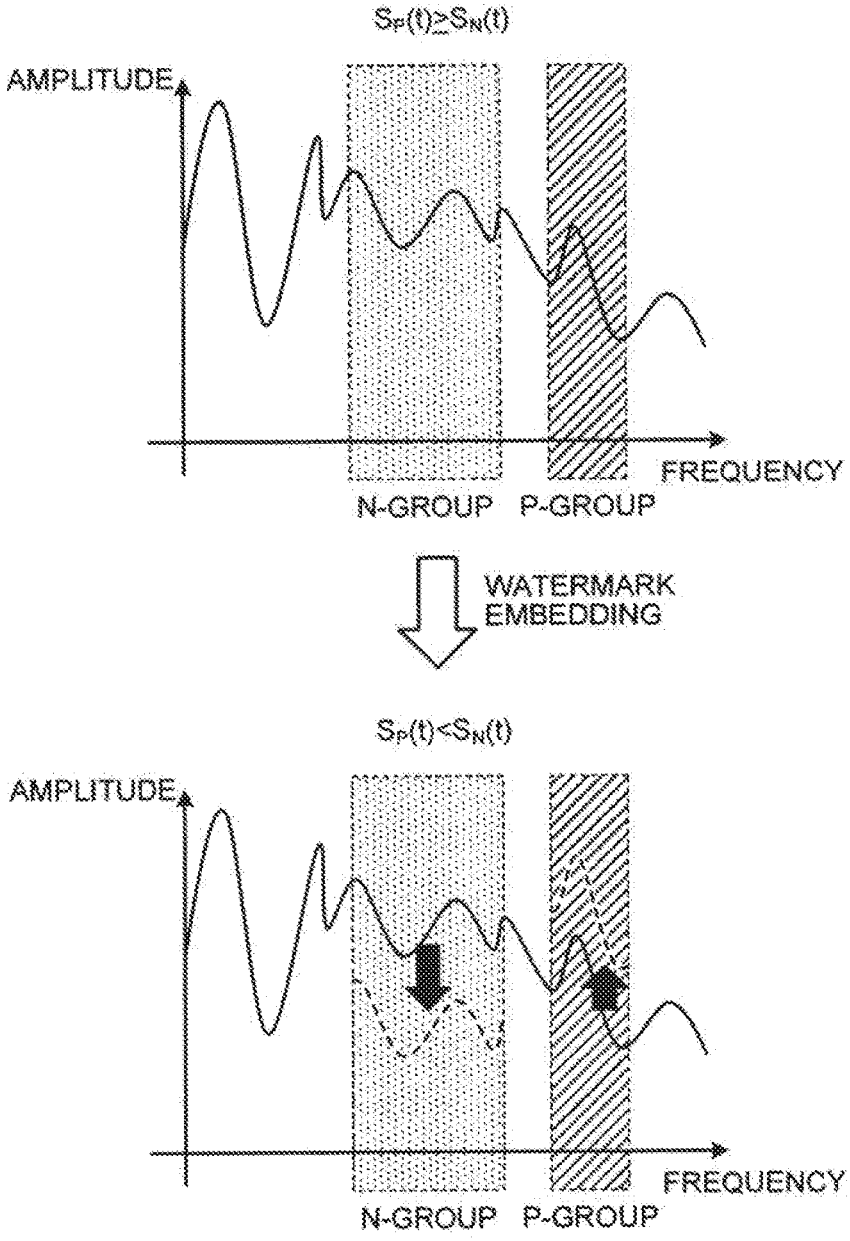
FIG. 3 is a diagram for explaining a method of embedding a watermark by the watermarked voice generating unit according to the first embodiment.

Explained below with reference to FIG. 3 are the details regarding the method by which the embedding unit 203 embeds a watermark. In FIG. 3, the upper diagram represents a particular unit frame 22 output by the transformation implementing unit 202. The horizontal axis represents a frequency, while the vertical axis represents an amplitude spectrum intensity. In the first embodiment, in FIG. 3, two types of subbands, namely, a P-group and an N-group are set. A subband includes at least two or more neighboring frequency bins. As far as the method of setting the P-group and the N-group is concerned, the entire frequency band is divided into a specified number of subbands based on a certain rule, and then the P-group and the N-group can be selected from the subbands. Meanwhile, the P-group and the N-group either can be set to be identical in all unit frames 22 or can be changed for each unit frame 22.

Assume that, in a particular unit frame 22, a 1-bit watermark bit $\{0, 1\}$ is embedded as additional information at the watermark strength $2\delta$ ($\delta \geq 0$). When $|X_t(W_k)|$ represents the amplitude spectrum intensity of a k-th frequency bin $W_k$ at a time t, and when $\Omega_p$ represents a set of all frequencies belonging to the P-group; then the sum of amplitude spectrum intensities of all frequency bins belonging to the P-group is expressed as the equation given below.

$$\sum_{k:\omega_k \in \Omega_p} |X_t(\omega_k)| = S_p(t) \tag{1}$$

In an identical manner, the sum of amplitude spectrum intensities of all frequency bins belonging to the N-group is expressed as $S_N(t)$. At that time, the magnitude relationship between $S_N(t)$ and $S_P(t)$ is varied according to the watermark bit to be embedded so that the following expressions are satisfied.

$S_P(t)-S_N(t) \geq 2\delta \geq 0$, if the watermark bit "1" is to be embedded at the watermark strength $2\delta$ $S_P(t)-S_N(t) < 2\delta < 0$, if the watermark bit "0" is to be embedded at the watermark strength $2\delta$ As an example, consider the case in which the watermark bit "1" is to be embedded in the unit frame 22 at the watermark strength $2\delta$. In the case of embedding the watermark bit "1", the intensity of each frequency bin can be varied in such a way that the magnitude relationship between the sums of amplitude spectrum intensities in the unit frame 22 satisfies $S_P(t)-S_N(t) \geq 2\delta$. That is, if the difference between pre-watermark-embedding amplitude intensities of the P-group and the N-group is $S_P(t)-S_N(t)=2\delta_0$ (where $\delta_0 \leq \delta$ is satisfied), the amplitude spectrum intensities of all frequency bins belonging to the P-group are increased by $(\delta-\delta_0)$ or more in all, while the amplitude spectrum intensities of all frequency bins belonging to the N-group are decreased by $(\delta-\delta_0)$ or more in all.

Meanwhile, instead of performing the operation explained above, it is possible to perform an operation of increasing the amplitude spectrum intensities of all frequency bins belonging only to the P-group by $(2\delta-2\delta_0)$ or more in all, or it is possible to perform an operation of decreasing the amplitude spectrum intensities of all frequencies "bins" belonging only to the N-group by $(2\delta-2\delta_0)$ or more in all. Meanwhile, in the case of $\delta<\delta_0$, since the condition in the equation (1) is already satisfied, it is also possible to think of a method in which a watermark is not embedded. In this way, the digital watermark bit that is embedded can be detected by comparing $S_P(t)$ and $S_N(t)$ in the subbands of the P-group and the N-group.

According to the explanation given above, the embedding unit 203 decides whether or not to embed a watermark in the input unit frame 22 according to the embedding timing 16. If a watermark is to be embedded, the embedding unit 203 embeds the watermark at the strength specified as the watermark strength 15.

Given below is the explanation of the intention understanding module according to the first embodiment. The intention understanding module understands the intention of the input text, and determines whether that text may become a potentially risky expression. The intention understanding module can be implemented using the existing known technology such as the technology disclosed in Patent Literature 2. In that technology, the meaning structure of an input English text is understood from the words and the articles present in that text, and main keywords that represent the intention of the text in the best manner are extracted. In the case of implementing that known technology for a Japanese text, it is desirable that the text is subjected to morpheme analysis and decomposed into articles. In case the text has the possibility of becoming a potentially risky expression, the types and the frequencies of appearance of the extracted keywords are often different as compared to the case in which the text does not have the possibility of becoming a potentially risky expression. For that reason, the statistical models based on frequencies of appearance of the keywords are trained, and it is identified whether the keywords extracted from the input text are close to which model. That enables determination of the potentially risky expressions.

In the digital watermark embedding device 1 according to the first embodiment described above, with respect to a unit frame including a potentially risky expression, the watermark strength is set at a higher level according to the degree of risk, and a digital watermark is embedded. On the other hand, with respect to a unit frame not including a potentially risky expression, no digital watermark is embedded. In this way, as a result of setting the watermark strength at a high level, the unit frames including potentially risky expressions become detectible with more certainty.

Second Embodiment

Figure 4:
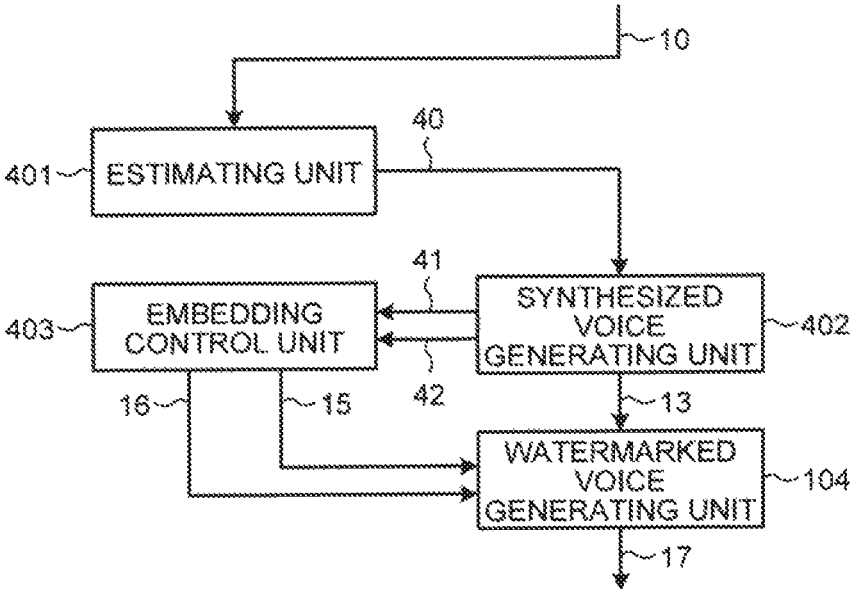
FIG. 4 is a block diagram illustrating a functional configuration of a digital watermark embedding device according to a second embodiment.

Given below is the explanation of a digital watermark embedding device 2 according to a second embodiment. As illustrated in FIG. 4, the digital watermark embedding device 2 includes an estimating unit 401, a synthesized voice generating unit 402, an embedding control unit 403, and the watermarked voice generating unit 104. The digital watermark embedding device 2 illustrated in FIG. 4 receives input of the input text 10 and outputs the synthesized voice 17 in which a digital watermark is embedded.

The estimating unit 401 obtains the input text 10 from outside. Then, the estimating unit 401 determines potentially risky segments from the input text 10 and decides on the degrees of risk of the potentially risky segments. Herein, the potentially risky segments and the degrees of risk of those sections are written as a text tag in the text 10. Then, the estimating unit 401 outputs a tagged text 40 to the synthesized voice generating unit 402.

The synthesized voice generating unit 402 obtains the tagged text 40 from the estimating unit 401. Then, the synthesized voice generating unit 402 extracts prosodic information such as phoneme sequences, pauses, the mora count, and accents from the tagged text 40; extracts a potentially risky segment and the degree of risk of a potentially risky expression; and generates the synthesized voice 13. In the second embodiment, in order to adjust to the timing of embedding the digital watermark, it is necessary to have phoneme-based alignment regarding each uttered phoneme. For that reason, the synthesized voice generating unit 402 calculates phoneme-based alignment 41 of the potentially risky expression by referring to the phoneme sequences, pauses, the mora count, and the potentially risky segments extracted from the tagged text 40; and calculates the degree of risk 42 of the potentially risky expression. Then, the synthesized voice generating unit 402 outputs the synthesized voice 13 to the watermarked voice generating unit 104, and outputs the phoneme-based alignment 41 of the potentially risky expression of the synthesized voice 13 and the degree of risk 42 of the potentially risky expression to the embedding control unit 403.

The embedding control unit 403 receives input of the phoneme-based alignment 41 of the potentially risky expression as output by the synthesized voice generating unit 402, and receives input of the degree of risk 42 of the potentially risky expression. Then, the embedding control unit 403 modifies the phoneme-based alignment 41 of the potentially risky expression as output by the synthesized voice generating unit 402 into the embedding timing 16 for embedding a watermark; and modifies the degree of risk 42 of the potentially risky expression into the watermark strength 15. Subsequently, the embedding control unit 403 outputs the watermark strength 15 and the embedding timing 16 to the watermarked voice generating unit 104.

As compared to the first embodiment, the difference herein is that the potentially risky segment estimated by the estimating unit 401 is added in the form of a text tag to the input text 10, and the input text 10 is output as the tagged text 40 to the synthesized voice generating unit 402.

Third Embodiment

Figure 5:
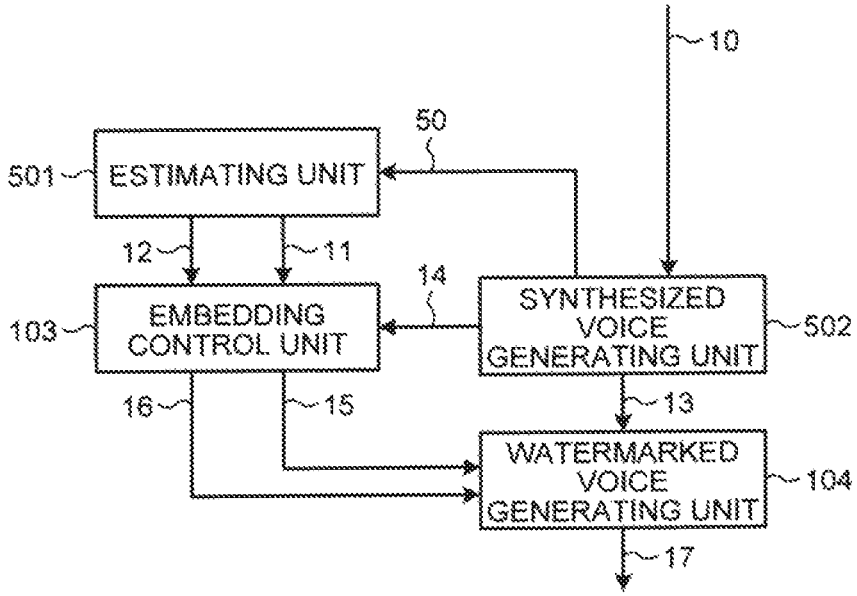
FIG. 5 is a block diagram illustrating a functional configuration of a digital watermark embedding device according to a third embodiment.

Given below is the explanation of a digital watermark embedding device 3 according to a third embodiment. As illustrated in FIG. 5, the digital watermark embedding device 3 includes an estimating unit 501, a synthesized voice generating unit 502, an embedding control unit 103, and a watermarked voice generating unit 104. The digital watermark embedding device 3 receives input of the input text 10 and outputs the synthesized voice 17 in which a digital watermark is embedded.

The synthesized voice generating unit 502 obtains the text 10 from outside. Then, the synthesized voice generating unit 502 extracts prosodic information such as phoneme sequences, pauses, the mora count, and accents from the input text 10; and generates the synthesized voice 13. Moreover, the synthesized voice generating unit 502 calculates the phoneme-based alignment 14 using the phoneme sequences, the pauses, and the mora count. Furthermore, the synthesized voice generating unit 502 generates intermediate language information 50 from the phoneme sequences and the accents and the like. The intermediate language information represents expression in the text format of the prosodic information that is obtained as a result of text analysis performed by the synthesized voice generating unit 502. Then, the synthesized voice generating unit 502 outputs the synthesized voice 13 to the watermarked voice generating unit 104; outputs the phoneme-based alignment 14 to the embedding control unit 103; and outputs the intermediate language information 50 to the estimating unit 501.

The estimating unit 501 obtains the intermediate language information 50 from the synthesized voice generating unit 502. Then, the estimating unit 501 refers to the intermediate language information 50 and determines the potentially risky segment, and decides on the degree of risk of the potentially risky segment. There can be various methods for determining the potentially risky segment. For example, a list of potentially risky expressions associated with respective intermediate language expressions can be stored, and the intermediate language information 50 can be searched to know whether or not any of the listed intermediate language expressions are included in the obtained intermediate language information 50. Regarding the degrees of risk of the potentially risky expressions, the degrees of risk can be associated with the listed intermediate language expressions in an identical manner to the first embodiment.

In the first embodiment, the estimating unit directly searches the input text 10 for the potentially risky expressions. In contrast, in the third embodiment, the potentially risky expressions are searched in the intermediate language information output by the synthesized voice generating unit 502.

Fourth Embodiment

Figure 6:
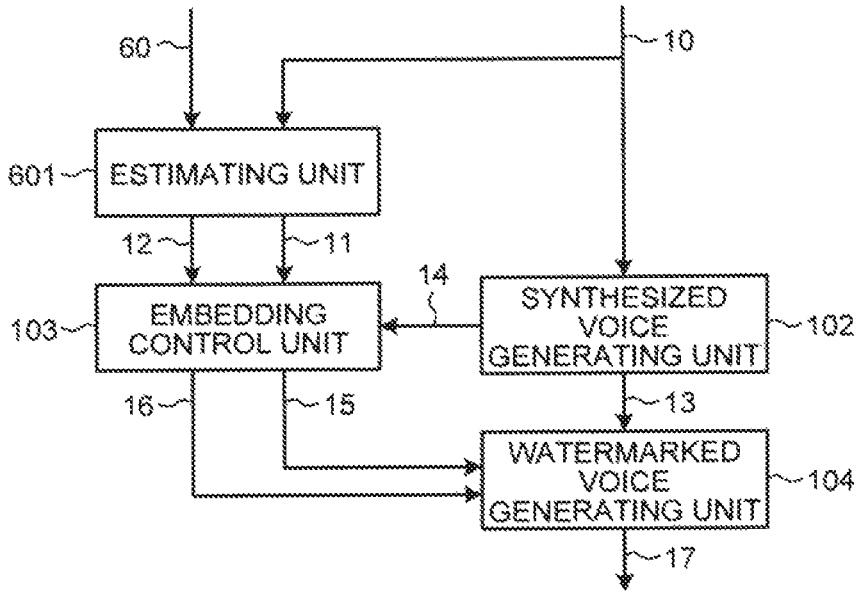
FIG. 6 is a block diagram illustrating a functional configuration of a digital watermark embedding device according to a fourth embodiment.

Given below is the explanation of a digital watermark embedding device 4 according to a fourth embodiment. As illustrated in FIG. 6, the digital watermark embedding device 4 includes an estimating unit 601, the synthesized voice generating unit 102, the embedding control unit 103, and the watermarked voice generating unit 104. The digital watermark embedding device 4 receives input of the text 10, and outputs the synthesized voice 17 in which a digital watermark is embedded.

The estimating unit 601 determines a potentially risky segment from the input text 10, and decides on the degree of risk of that section using an input signal 60. In the first embodiment, the degree of risk is uniquely decided according to the input text 10. However, even if the same text is used, sometimes it is suitable to vary the degree of risk of a potentially risky expression depending on the person speaking in a resembling voice. Hence, in the fourth embodiment, the degree of risk of the concerned section is varied using the input signal 60. For example, even if the input text 10 includes an obscene expression, it is only natural to vary the degree of risk of the potentially risky expression for the following cases:

a case in which the voice resembles to an idol who has a pure and innocent image and is having an explosion in popularity a case in which the voice resembles to an entertainer who is good at making people laugh using blue jokes In the former case, in order to prevent defamation, it is desirable that the degree of risk of the concerned section is set at a high level and the obscene expression is detected with certainty. Meanwhile, the input signal 60 is not limited to the information about the person speaking in a resembling voice. Alternatively, for example, if the user of this device uses the same potentially risky expression many times, then the degree of risk can be increased at each instance of use by considering it to be the use with malicious intent. Thus, the number of times for which the user uses the potentially risky expression can be included in the input signal 60.

In the first embodiment, in the estimating unit 101, the degree of risk 12 of the potentially risky expression cannot be varied from other than the input text 10. In contrast, in the fourth embodiment, the degree of risk 12 can be varied according to conditions other than the input text 10.

Figure 7:
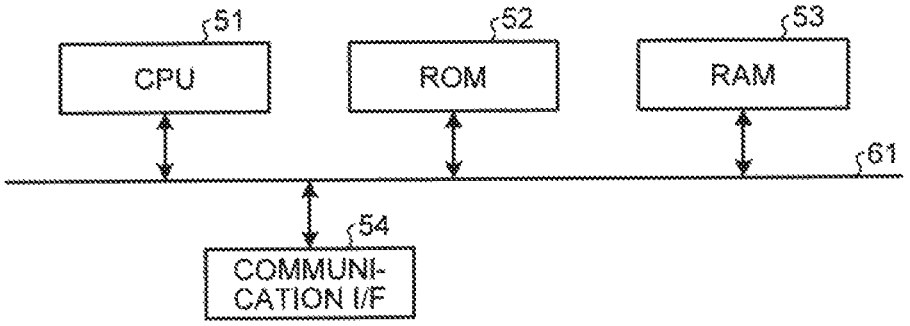
FIG. 7 is a block diagram illustrating a hardware configuration of the digital watermark embedding device according to the embodiments.

Explained below with reference to FIG. 7 is a hardware configuration of the digital watermark embedding device according to the embodiments. FIG. 7 is an explanatory diagram illustrating a hardware configuration of the digital watermark embedding device according to the embodiments and a hardware configuration of a detecting device.

The digital watermark embedding device according to the embodiments includes a control device such as a CPU (Central Processing Device) 51, memory devices such as a ROM (Read Only Memory) 52 and a RAM (Random Access Memory) 53, a communication I/F 54 that establishes connection with a network and performs communication, and a bus 61 that connects the constituent elements to each other.

A program executed in the digital watermark embedding device according to the embodiments is stored in advance in the ROM 52.

Alternatively, the program executed in the digital watermark embedding device according to the embodiments can be recorded as an installable file or an executable file in a computer-readable recording medium such as a CD-ROM (Compact Disk Read Only Memory), a flexible disk (FD), a CD-R (Compact Disk Recordable), or a DVD (Digital Versatile Disk); and can be provided as a computer program product.

Still alternatively, the program executed in the digital watermark embedding device according to the embodiments can be saved as a downloadable file on a computer connected to a network such as the Internet or can be made available for distribution through a network such as the Internet.

The program executed in the digital watermark embedding device according to the embodiments can make a computer function as the constituent elements described above. In that computer, the CPU 51 can read the program from a computer-readable storage medium into a main memory device and execute the program. Meanwhile, some or all of the constituent elements can alternatively be implemented using hardware circuitry.

While certain embodiments of the invention have been described, the embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A digital watermark embedding device comprising:

one or more processors; and a memory storing instructions that, when executed by the one or more processors, performs operations, comprising:

outputting a synthesized voice according to an input text and phoneme-based alignment regarding phonemes included in the synthesized voice;

estimating whether or not a potentially risky expression is included in the input text, and outputting a potentially risky segment in which the potentially risky expression is estimated to be included;

associating the potentially risky segment with the phoneme-based alignment, and deciding and outputting an embedding time for embedding a watermark in the synthesized voice; and embedding a digital watermark in the synthesized voice at a time specified as the embedding time for the synthesized voice, wherein the estimating includes outputting a degree of risk of the potentially risky expression that is included in the potentially risky segment, the associating includes setting an embedding strength of the digital watermark based on the degree of risk and outputting the embedding strength, the embedding includes embedding the digital watermark in a sub-band of the synthesized voice based on the embedding strength, the sub-band including at least two neighboring frequency bins, and the embedding further includes embedding a digital watermark bit based on a difference in summed amplitude spectrum intensity between different sub-bands satisfying a threshold.

2. The digital watermark embedding device according to claim 1, wherein according to intermediate language information that is input, the outputting the synthesized voice includes outputting the synthesized voice and the phoneme-based alignment regarding phonemes included in the synthesized voice, and the estimating includes estimating whether or not the potentially risky expression is included in the intermediate language information that is input, and outputting the potentially risky segment in which the potentially risky expression is estimated to be included.

3. The digital watermark embedding device according to claim 1, wherein the estimating includes writing and outputting the potentially risky segment and the degree of risk in a form of a text tag in the input text, and based on the text in which the text tag is written, the outputting the synthesized voice includes outputting the synthesized voice and phoneme-based alignment regarding phonemes included in the potentially risky expression.

4. The digital watermark embedding device according to claim 1, wherein the outputting the synthesized voice includes outputting intermediate language information in which prosodic information obtained by performing text analysis of the input text is given in text format, and the estimating includes estimating whether or not the potentially risky expression is included in the intermediate language information that is input, and outputting the potentially risky segment in which the potentially risky expression is estimated to be included.

5. The digital watermark embedding device according to claim 1, wherein the estimating includes referring to information included in an input signal received from outside and deciding on the degree of risk of the potentially risky segment in the input text.

6. A digital watermark embedding method comprising:

a synthesized voice generating step that includes outputting a synthesized voice according an input text and outputting phoneme-based alignment regarding phonemes included in the synthesized voice;

an estimating step that includes estimating whether or not a potentially risky expression is included in the input text, and outputting a potentially risky segment in which the potentially risky expression is estimated to be included;

an embedding control step that includes associating the potentially risky segment with the phoneme-based alignment, and deciding and outputting an embedding time for embedding a watermark in the synthesized voice; and an embedding step that includes embedding a digital watermark in the synthesized voice at a time specified in the embedding time for the synthesized voice, wherein the estimating step outputs a degree of risk of the potentially risky expression that is included in the potentially risky segment, the embedding control step sets an embedding strength of the digital watermark based on the degree of risk and outputs the embedding strength, the embedding step embeds the digital watermark in a sub-band of the synthesized voice based on the embedding strength, the sub-band including at least two neighboring frequency bins, and the embedding step further embeds a digital watermark bit based on a difference in summed amplitude spectrum intensity between different sub-bands satisfying a threshold.

7. A non-transitory computer-readable recording medium containing a computer program that causes a computer to execute:

a synthesized voice generating step that includes outputting a synthesized voice according an input text and outputting phoneme-based alignment regarding phonemes included in the synthesized voice;

an estimating step that includes estimating whether or not a potentially risky expression is included in the input text, and outputting a potentially risky segment in which the potentially risky expression is estimated to be included;

an embedding control step that includes associating the potentially risky segment with the phoneme-based alignment, and deciding and outputting an embedding time for embedding a watermark in the synthesized voice; and an embedding step that includes embedding a digital watermark in the synthesized voice at a time specified in the embedding time for the synthesized voice, wherein the estimating step outputs a degree of risk of the potentially risky expression that is included in the potentially risky segment, the embedding control step sets an embedding strength of the digital watermark based on the degree of risk and outputs the embedding strength, the embedding step embeds the digital watermark in a sub-band of the synthesized voice based on the embedding strength, the sub-band including at least two neighboring frequency bins, and the embedding step further embeds a digital watermark bit based on a difference in summed amplitude spectrum intensity between different sub-bands satisfying a threshold.

* * * * *